United States Patent [19]

Kishikawa et al.

[11] Patent Number: 4,503,700

[45] Date of Patent: Mar. 12, 1985

[54] METHOD OF ROLLING RAILS

[75] Inventors: Kanichi Kishikawa; Taneharu Nishino, both of Kitakyushu, Japan

[73] Assignee: Nippon Steel Corporation, Tokyo, Japan

[21] Appl. No.: 509,013

[22] Filed: Jun. 27, 1983

[30] Foreign Application Priority Data

Jun. 30, 1982 [JP] Japan ..... 57-111450

[51] Int. Cl.[3] ..... B21B 1/08

[52] U.S. Cl. ..... 72/225; 72/234; 72/366

[58] Field of Search ..... 72/225, 226, 221, 222, 72/234, 366

[56] References Cited

U.S. PATENT DOCUMENTS

| | | | |
|---|---|---|---|
| 3,597,954 | 8/1971 | Nakajima et al. | 72/225 |
| 3,657,912 | 4/1972 | Ishibashi et al. | 72/234 |
| 4,301,670 | 11/1981 | Engel et al. | 72/226 |
| 4,370,877 | 2/1983 | Michaux | 72/225 X |
| 4,393,680 | 7/1983 | Kovacs | 72/234 |
| 4,400,962 | 8/1983 | Michaux | 72/222 |
| 4,408,475 | 10/1983 | Mennel | 72/221 |

FOREIGN PATENT DOCUMENTS

| | | | |
|---|---|---|---|
| 0070002 | 4/1982 | Japan | 72/366 |

*Primary Examiner*—Leon Gilden
*Assistant Examiner*—Steven B. Katz
*Attorney, Agent, or Firm*—Wenderoth, Lind & Ponack

[57] ABSTRACT

A rail is rolled from a hot-rolled bloom having a square or rectangular cross section by a method which is constituted by the steps of breakdown rolling, universal rolling, which is effected by causing the bloom to travel through a plurality of stands making only a single pass on each stand, base-wheel rolling, head-wheel rolling and edging. The bloom is broken down into substantially H-shaped beam blank whose cross section is symmetrical with respect to the center line of its web. In the base-wheel rolling, the flanges of the blank corresponding to the head and base of the rail are respectively rolled widthwise and thicknesswise in three or more passes using a pair of horizontal rolls and a vertical roll, respectively.

4 Claims, 7 Drawing Figures

METHOD OF ROLLING RAILS

BACKGROUND OF THE INVENTION

This invention relates to a method of rolling rails, and more particularly to a method of rolling rails using continuous rolling mills, including a universal mill, for H-sections.

Generally, universal rolling is divided into two steps; one is a process in which bloom is processed through pass grooves in two horizontal rolls and the other is a process in which the thus processed bloom, or breakdown, is further processed into the desired product through universal stands. The former is known as the roughing process and the latter as the universal process. Application of universal rolling to rails has brought about a considerable cutback in production cost and a remarkable improvement in quality and dimensional accuracy, compared with the conventional passgroove rolling method. However, the roughing process needs special operating techniques such as reduction, upsetting, twisting and turning. Besides, as many as 12 to 14 passes must be made through the pass grooves in the rolls on the two roughing stands, the time for this roughing operation accounting for approximately 70 percent of the total pass time for each rail.

FIG. 1*a* shows a rail-rolling mill train of the conventional type and the arrangement of the roll passes thereof. This rail mill consists of two breakdown stands $BD_1$ and $BD_2$, a four-roll universal stand $U_1$, an edger stand E, a four-roll universal stand $U_2$, a head-wheel stand H, and a base-wheel stand B. Thus, universal rolling consists of four steps; four-roll universal stand rolling aimed principally at elongation, edger rolling, head-wheel rolling and base-wheel rolling aimed principally at reforming. With a greater portion of reduction of the head and base carried out by the four-roll universal stand in the direction of thickness, the breakdown obtained in this method has a larger section that is substantially similar to the desired rail in shape, as shown in FIG. 2*a*. In order to obtain the breakdown shaped like this, the difference in width between the head and base must be accomplished in the roughing operation, as indicated by the pass grooves on the roughing stands $BD_1$ and $BD_2$. This calls for providing many roll passes and installing two roughing stands $BD_1$ and $BD_2$ one after the other. As a consequence, the amount which can be produced in the roughing operation governs the productivity of the universal rail rolling operation as a whole.

Meanwhile, it is well-known that H-sections can be continuously manufactured by making only a single pass through such universal stands as stands $B_1'$, $U_1$, $U_2$, $B_2'$, $U_3$, $B_3'$, edger stands E, $H_1'$, $H_2'$, and so on after a breakdown stand BD. It is preferable to roll rails using such a continuous H-section mill since it provides various advantages including the integration of mills.

SUMMARY OF THE INVENTION

An object of this invention is to provide a method of rolling rails that permits an easy switch from the rolling of H-sections to rails and vice versa.

Another object of this invention is to provide a method of rolling rails with a high rate of productivity by simplifying the shortening the time of the breakdown step.

Still another object of this invention is to provide a method of rolling rails that permits manufacturing rails and H-sections from common beam blanks.

In rolling rails according to the method of this invention which includes the steps of breakdown, universal and base-wheel rolling, hot-rolled blooms are broken down into substantially H-shaped beam blanks having a cross section symmetrical with respect to the center line of the web. In the base-wheel rolling step, the flange of the beam blank corresponding to the head of the rail is reduced widthwise using a pair of horizontal rolls and the beam flange corresponding to the base of the rail is reduced in the direction of thickness using a vertical roll, in three or more passes individually.

As mentioned previously, the rail rolling method of this invention uses H-shaped beam blanks as the starting material. Accordingly, it is easy to change over from the rolling of H-sections to that of rails or vice versa by changing the rolls on some stands in a mill train. By changing rolls, for example, a base-wheel rolling stand becomes a universal stand. The changing of rolls is easy because rolls for both base-wheel and universal rolling are supported by a common structure.

The use of simple, H-shaped beam blanks permits reducing the number of breakdown passes, extensively cutting down the time of the breakdown operation, and enhancing the productivity of rail rolling. The use of common beam blanks for both H-sections and rails allows integration of their starting materials.

DETAILED DESCRIPTION OF THE PREFERRED EMBODIMENTS

Figure 1A:
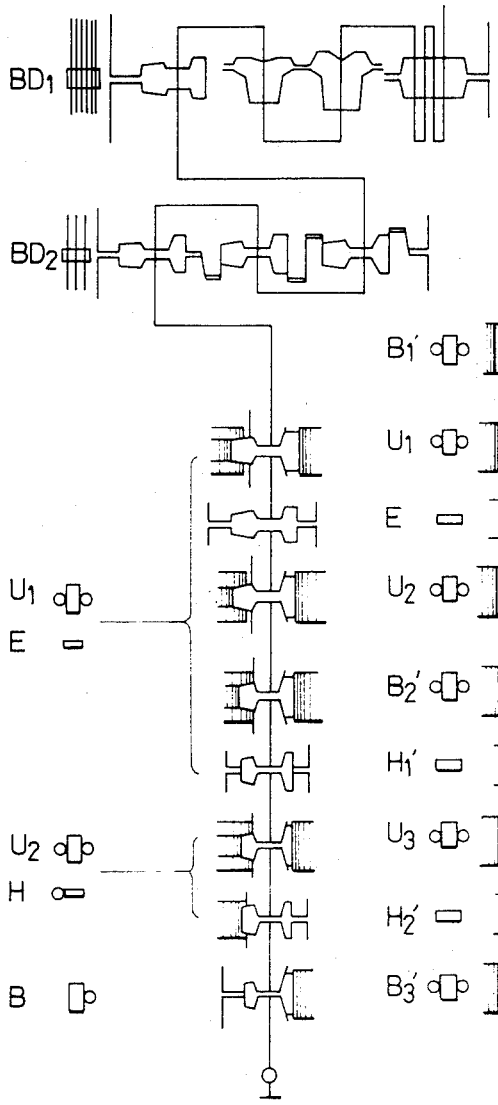
FIG. 1a PRIOR ART
FIGS. 1*a* and 1*b* show arrangements of rolling mill stands and roll passes, the former being for the conventional rail rolling and the latter for the rolling of both H-sections and rails according to this invention.

This invention offers a solution for the aforementioned productivity problem with the conventional universal rail rolling by the effective utilization of a continuous H-section mill having a larger number of stands.

The use of H-shaped beam blanks with a relatively simple cross section makes it possible to accomplish the roughing operation with only a single roughing stand, dispensing with difficult operating techniques. Consequently, the greater part of the rail forming according to this invention is effected in the subsequent universal rolling step, in which it is essential to elongate both flanges at the right and left at substantially the same rate. The fact that the cross-sectional area of the head and base of the rail is basically substantially the same permits both flanges to be elongated equally in each pass.

Taking advantage of the fact that the head and base of rails have substantially the same cross-sectional area, this invention discloses a method of rolling a rail having an asymmetrical cross section through a series of continuous universal stands using an H-shaped beam blank having a symmetrical cross section with respect to the center line of the web, without deviating from the basic rolling requirement that the individual parts of the piece must be elongated at substantially the same rate. One of the flanges is rolled into the head and the other into the base.

A feature of this invention lies in the fact that the differently shaped head and base of a rail are formed by applying widthwise and thicknesswise reductions, respectively, using three or more base-wheel rolling stands as distinguished from conventional methods. The H-shaped beam blank is rolled into rail form by passing through the base-wheel pass three or more times. Although the number of base-wheel passes required depends upon the shape and size of the rail, three passes suffice for most rails. Another feature is the provision of a required number of four-roll universal stands for the forging of the uppermost portion of the rail head and the prevention of surface defects. Still another feature is that only one pass is made in each of the continuous finishing stands when applying the principle of this invention. More specifically, the base-wheel rolling according to this invention is a three-roll universal rolling in which the head and web are reduced by a pair of horizontal rolls and the base by a vertical roll. In order to ensure that the head, base and web of a rail are elongated at the same rate through each pass, no more than one pass should be allowed in each stand. This is why many stands are used for continuous finishing rolling. This permits rolling rails from simple H-shaped beam blanks, streamlining the roughing process which in the conventional method accounts for approximately 70 percent of the total rail rolling time, and yet at the same time using the same starting material that is used for the manufacture of H-sections and I beams.

Now preferred embodiments of this invention will be described in detail by reference to the accompanying drawings and in comparison with an example of the conventional method.

Figure 1B:
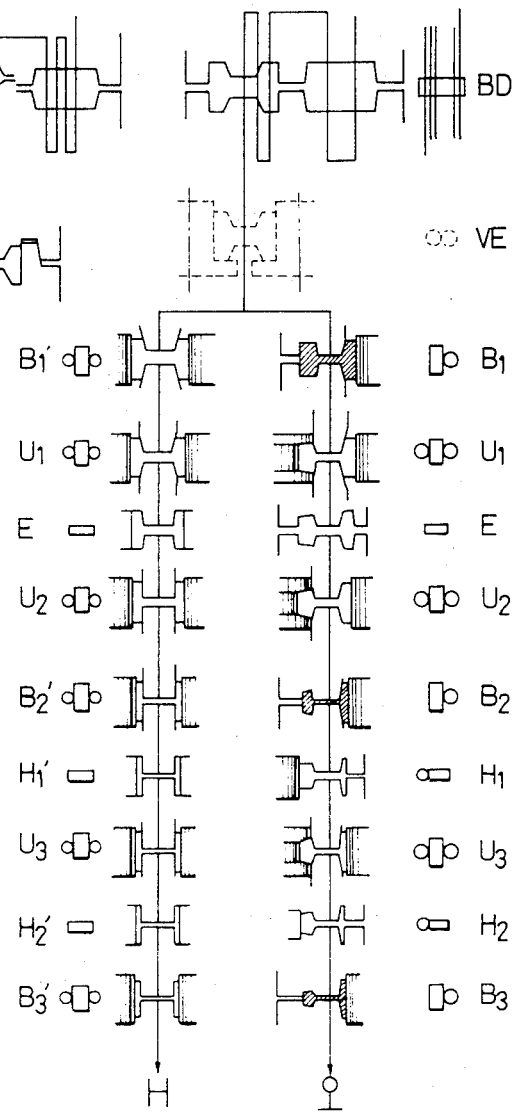

FIG. 1*a* schematically shows a rail rolling mill train and process according to a conventional method. FIG. 1*b* schematically shows a rail and H-section rolling mill train and process according to this invention. Although it is possible for the two methods to roll both rails and H-sections, the method according to this invention is simpler because it uses the same beam blank for both rails and H-sections. Thus, how the rail and H-section are made from the same starting material is shown in FIG. 1*b*.

In the universal rolling of the conventional method, the base is rolled by a vertical roll and the head is formed by a pass formed between a pair of horizontal rolls only in the final finishing process (on the base-wheel stand B in FIG. 1*a*). Prior to finishing, the piece makes several passes through the universal stands $U_1$, $U_2$ in FIG. 1*a*, with the web held between the horizontal rolls and the head and base between the vertical rolls on both sides. Accordingly, the beam blank resembles the rail to be manufactured in shape, but is larger in size. In order to obtain such a beam blank, the head and base having different widths must be formed in the roughing operation according to the conventional roll-pass method (using the roughing stands $BD_1$ and $BD_2$ in FIG. 1*a*). This method requires an increased number of roughing passes and, therefore, requires using two roughing stands $BD_1$ and $BD_2$ rather than one. By contrast, the method of this invention requires only one roughing pass, on the roughing stand BD in FIG. 1*b*, due to the use of H-shaped beam blanks.

Figure 2A:
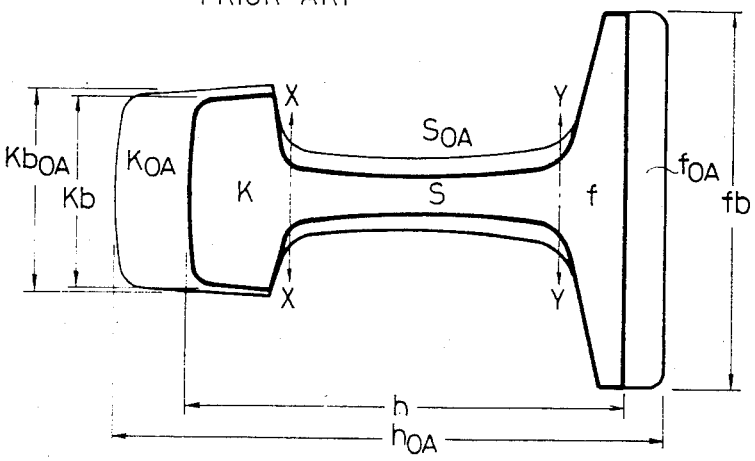
FIG. 2a PRIOR ART
FIGS. 2*a* and 2*b* show the cross-sectional relationships between the beam blank and rail, the former being for the conventional method and the latter for the method of this invention.
Figure 2B:
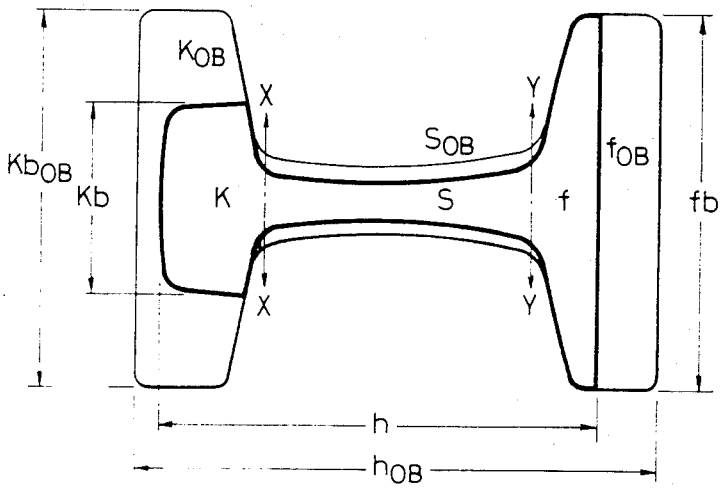

FIGS. 2*a* and 2*b* show how the roll pass for the universal rolling is divided into three sections. The line X—X separates the head section K from the web section S and the line Y—Y separates the base section f from the web section S. The shape of the beam blani from which a rail is to be rolled according to the conventional method is obtained by enlarging the individual parts K, S and f of the desired rail into sections $K_{OA}$, $S_{OA}$, and $f_{OA}$ as shown in FIG. 2*a*. Similarly, the shape of the beam blank from which a rail is to be rolled according to this invention is obtained by enlarging the individual parts K, S and f into sections $K_{OB}$, $S_{OB}$ and $f_{OB}$. In the former beam blank, the top of the head is enlarged greatly while the sides thereof are enlarged only slightly. In the beam blank of this invention, in contrast, the sides of the head are enlarged more pronouncedly than the top thereof. In the beam blank for the conventional method, the total height h is increased to $h_{OA}$ which the amount corresponding to the amount of reduction achieved in the passes on the universal stand, whereas the width of the head Kb is increased only slightly to $Kb_{OA}$. In the beam blank according to this invention, the total height h is not increased so greatly as in the conventional one, but the head width Kb is greatly expanded to $Kb_{OB}$. One of the key points of this invention is to obtain the H-shaped beam blank as shown in FIG. 2*b*. The basic design feature of rails mainly used around the world is that the head and base have substantially the same cross-sectional area as shown by the rails listed in the following table.

TABLE 1

| Rail Description Kg/m | Head $mm^2$ | Base $mm^2$ | Head/Base Ratio | Remarks |
|---|---|---|---|---|
| 60 JIS or JRS | 2840 | 3123 | 0.91 | Japan, Shinkansen (Super-Express) lines |
| 50 JIS or JRS | 2750 | 2495 | 1.10 | Japan, ordinary lines |
| 50 PS | 2700 | 2640 | 1.02 | U.S.A. |
| 53 AS | 2710 | 2510 | 1.08 | Australia |
| 60 AS | 2960 | 2770 | 1.07 | Australia |
| 136 lbRE | 3314 | 3170 | 1.05 | U.S.A. |
| 132 lbRE | 3095 | 2955 | 1.05 | " |
| 116 lbRE | 2668 | 2844 | 0.94 | " |

Since the head and base have substantially the same cross-sectional area, the desired H-shaped beam blank can be the starting blank and an intermediate and finish rolling processes used in which the base is rolled by the same method as in the conventional method and the head is formed by forging the sides and top thereof alternately.

Figure 3A:
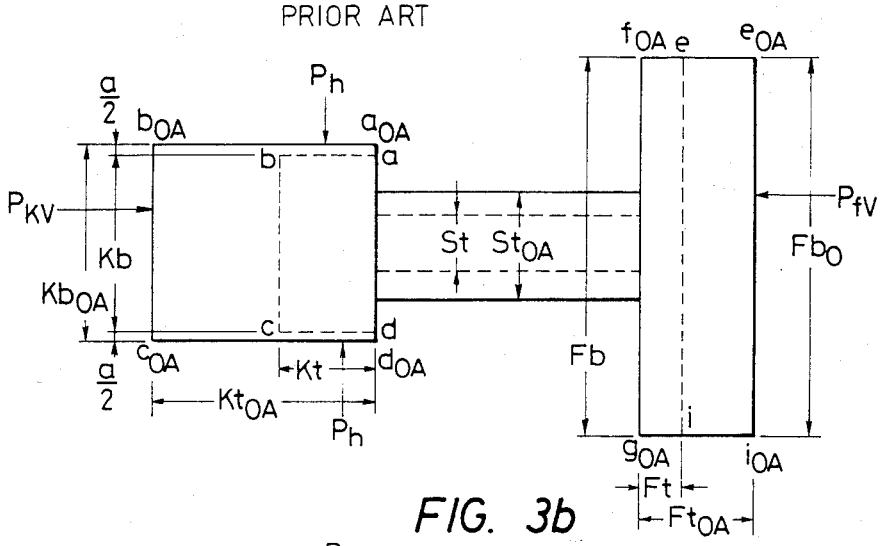
FIG. 3a PRIOR ART
FIGS. 3*a* and 3*b* show the cross-sectional dimensions of the beam blank and rail, the former being for the conventional method and the latter for the method of this invention.
Figure 3B:
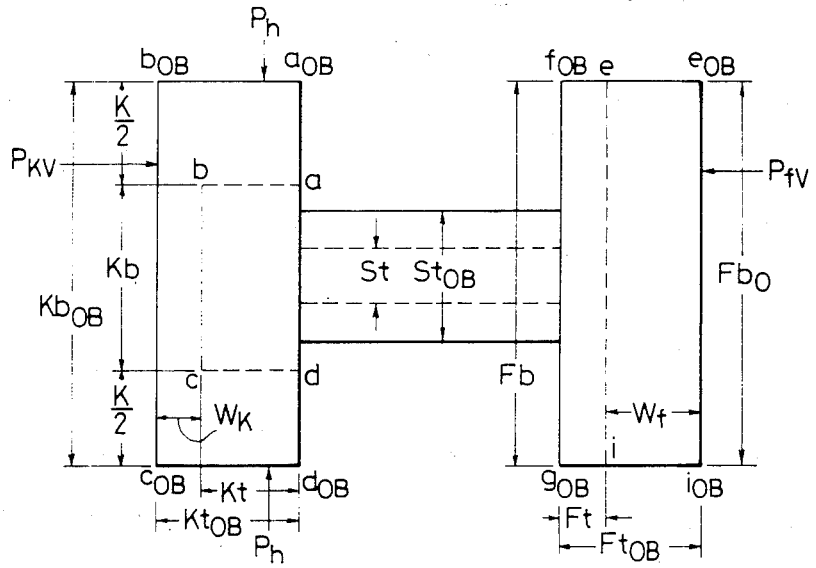

FIGS. 3*a* and 3*b* are schematic illustrations that show how the roll passes for the beam blanks are designed. Namely, FIGS. 3*a* and 3*b* show the relationship between the product rails and beam blanks according to the conventional method and this invention, respectively. In both figures, reference numerals a, b, c and d indicate the four corners of the rail head, e, f, g and i indicate the four corners of the rail base, and St designates the thickness of the rail web. In FIG. 3*a*, reference numerals $a_{OA}$, $b_{OA}$, $c_{OA}$ and $d_{OA}$, reference numerals $e_{OA}$, $f_{OA}$, $g_{OA}$ and $i_{OA}$, and reference numeral $st_{OA}$ designate like portions of the beam blank, and the same numerals but with the subscript OB designate like portions in FIG. 3*b*.

One of the features of the universal rail rolling operation is the forging of the head top. In FIGS. 3*a* and 3*b*, reference numerals $P_{KV}$, $P_h$ and $P_{fV}$ indicate the direction in which reduction is applied. In the old pass rolling method, the head top was forged only with a slight frictional force applied (in direction $P_{KV}$) by the sliding of the collar of the rolls contacting the sides of the head. On the other hand, the universal rolling method now in use actively forges the head top at least one to four times by directly applying pressure (in direction $P_{KV}$) with the vertical roll. The method of this invention also applies this highly effective direct forging (in direction $P_{KV}$) once or twice. Accordingly, the flange thickness $F_{tOB}$ and head thickness $K_{tOB}$ in FIG. 3*b* is expressed as $$F_{tOB} = K_{tOB} = K_t + W_k$$

$$= K_t \times \epsilon^2 \text{ (when direct forging is applied twice on the head top)}$$

where $K_T$ is the thickness of the finished head, $W_k$ is the total reduction in the thickness of the head, and $\epsilon$ is the mean ratio of elongation.

The width of the base or flange of the beam blank $F_{bo}$ is substantially the same as that of the product rail, i.e., $F_{bo}=F_b$. While the thickness of the base or flange of the beam blank is reduced in each pass by the pressure directly applied (in direction $P_{fv}$) by the vertical roll, the width of the flange expands then but is forged and reformed in the subsequent reforming stand. Therefore, it may safely be said that the flange width of the beam blank remains substantially unchanged throughout. For the thickness of the web, the average ratio of elongation of the beam blank and that of the finished rail is used.

Using these values, the smallest cross section of the H-shaped beam blank necessary for the universal rail rolling operation can be determined.

The key problem in the method of this invention is the forming and forging of the rail head. Although it is possible to make the flange thickness equal to the minimum required thickness of the rail head, it is a deviation from the object of this invention to eliminate the forging of the head through the direct application of pressure thereon which is an important advantage the universal rail rolling operation offers. Direct application of pressure on the head top is also necessary in one half of the total passes in order to eliminate fine "wrinkles" that arise when the flange width is reduced to the desired width of the rail head. Now a specific explanation will be given using the RE1321b rail as an example. Reference numerals correspond to those used in FIG. 3*b*. The specification of the RE1321b rail is as follows:

Head width: Kb=74.68 mm

Base width: Fb=152.4 mm

Head area: Ka=3095 mm$^2$

Base area: Fa=2955 mm$^2$ $$\text{Mean head thickness } Kt = \frac{Ka}{Kb} = \frac{3095}{74.68}$$

$$= 41.44 \text{ mm}$$

$$\text{Mean base thickness } Ft = \frac{Fa}{Fb} = \frac{2955}{152.4}$$

-continued $$= 19.39 \text{ mm}$$

By using an empirical mean elongation ratio of 1.19 to 1.25 (without including the amount of deformation on the reforming stand), the mean reduction in area $\eta$ (without including the amount of deformation on the reforming stand)=16% to 20%.

When pressure W is applied directly on the head top in three passes, the flange thickness is expressed as $$K_{tOB} = F_{tOB} = K_t \cdot \epsilon^3$$

$$= 41.44 \times 1.19^3$$

$$\approx 70 \text{ mm}$$

In universal rolling, the base (or flange) is reduced in only one direction ($P_{fv}$) while the head is reduced in two directions, i.e. from above the top or in direction $P_{xv}$ and from both sides or in direction $P_h$. Therefore, the number of passes can be determined easily be calculating the reduction in flange area as follows (n=the number of passes):

$$\eta = \left(1 - \sqrt[n]{\frac{Ft}{F_{tOB}}}\right) 100$$

$$= \left(1 - \sqrt[n]{\frac{19.39}{70}}\right) 100$$

when $\eta$=16.8%, n=7.

when $\eta$=19.5%, n=6.

Referring again to FIG. 1*b*, a mill train with six passes, which requires less capital investment, will be described in the following. FIG. 1*b* is a schematic layout of a rail mill train comprising three four-roll universal stands $U_1$, $U_2$, $U_3$, three base-wheel stands $B_1$, $B_2$, $B_3$, three reforming stands E, $H_1$, $H_2$, and a roughing stand BD (plus a vertical reforming stand VE that can be used also for the rolling of H-sections).

A heated bloom having a square or rectangular cross section is rolled into an H-shaped beam blank through the breakdown stand BD, whence the place is led to the base-wheel stand $B_1$. The head is reduced through the three base-wheel stands $B_1$, $B_2$, $B_3$ and the three universal stands $U_1$, $U_2$, $U_3$ of the conventional type. Although the same number of stands can be arranged in many different ways, the one according to this invention has been decided with emphasis laid on the elimination of "wrinkles" and the forging of the head during the rolling of the H-shaped beam blank into the desired rail.

In the mill train shown in FIG. 1*b*, it is easy to change the rolls for rail rolling with those for H-section rolling and vice versa. When rail rolling is switched to H-section rolling, the base-wheel stands $B_1$, $B_2$ and $B_3$ are changed to simple universal stands $B'_1$, $B'_2$ and $B'_3$. The base-wheel stand has a vertical roll to form the base of a rail and another vertical roll on the opposite side to receive the reaction force applied by the former vertical roll. In rolling H-sections, said two vertical rolls are used for forming the flange thereof. Similarly, the head-wheel stands $H_1$ and $H_2$ are changed to edger stands $H'_1$ and $H'_2$ by removing the vertical roll from each stand. Of course, all horizontal rolls are changed to those for H-section rolling. As might be understood, the change is limited to the rolls, and there is no need to change the stands.

Table 2 shows the design values of the head and base of the RE1321b rail manufactured on the rolling mill being discussed. The cross-sectional imbalance between the head and base is eliminated in the first half of the rolling operation, with both sides thereof being elongated at the same rate near the finishing process in the second half. Table 3 lists the design values of the same rail manufactured by the conventional method shown in FIG. 1*a*. The difference between the two methods lies in the manufacture of the rail head as compared in Table 4.

TABLE 2

| | | BD | $B_1$ | $U_1$ | $U_2$ | $B_2$ | $U_3$ | $B_3$ |
|---|---|---|---|---|---|---|---|---|
| Head | Width $Kb_O$ mm | 152.4 | 106.5 | 110.0 | 113.0 | 79.0 | 82.0 | 74.7 |
| | Widthwise Reduction $\Delta K$ mm | | 45.9 | | | 34.0 | | 7.3 |
| | Thickness $Kt_O$ mm | 70.0 | 75.0 | 60.0 | 45.0 | 52.0 | 41.0 | 41.4 |
| | Thickness-wise Reduction $\Delta W_K$ mm | | | 15.0 | 15.0 | | 11.0 | |
| | Cross-Sectional Area $K_O$ mm$^2$ | 10650 | 8030 | 6380 | 5100 | 4100 | 3360 | 3090 |
| | Reduction Ratio e % | | 24.6 | 20.5 | 20.0 | 19.5 | 18.0 | 8.0 |
| Base | Width $Fb_O$ mm | 152.4 | 152.4 | 152.4 | 152.4 | 152.4 | 152.4 | 152.4 |
| | Thickness $Ft_O$ mm | 70.0 | 52.2 | 40.5 | 32.0 | 25.8 | 21.2 | 19.4 |
| | Thickness-wise Reduction $\Delta W_F$ mm | | 17.8 | 11.7 | 8.5 | 6.2 | 4.6 | 2.0 |
| | Cross-sectional Area $F_O$ mm$^2$ | 10650 | 7930 | 6150 | 4870 | 3920 | 3210 | 2955 |
| | Reduction Ratio e % | | 25.5 | 22.5 | 21.0 | 19.5 | 18.0 | 8.0 |

TABLE 3

| | | BD | $U_1$ | $U_1$ | $U_1$ | $U_2$ | B |
|---|---|---|---|---|---|---|---|
| Head | Width $Kb_O$ mm | 82.0 | 82.0 | 82.0 | 82.0 | 82.0 | 74.7 |
| | Widthwise Reduction $\Delta K$ mm | | | | | | 7.3 |
| | Thickness $Kt_O$ mm | 98.0 | 77.8 | 62.2 | 50.0 | 41.0 | 41.4 |
| | Thickness-wise Reduction $\Delta W_K$ mm | | 20.2 | 15.6 | 12.2 | 9.0 | |
| | Cross-Sectional Area $K_O$ mm$^2$ | 8040 | 6380 | 5100 | 4100 | 3360 | 3090 |
| | Reduction Ratio e % | | 20.6 | 20.1 | 19.6 | 18.0 | 8.0 |
| Base | Width $Fb_O$ mm | 152.4 | 152.4 | 152.4 | 152.4 | 152.4 | 152.4 |
| | Thickness $Ft_O$ mm | 52.2 | 40.5 | 32.0 | 25.8 | 21.2 | 19.4 |
| | Thickness-wise Reduction $\Delta W_f$ mm | | 11.7 | 8.5 | 6.2 | 4.6 | 1.8 |
| | Cross-Sectional Area $F_O$ mm$^2$ | 7930 | 6150 | 4870 | 3920 | 3210 | 2955 |
| | Reduction Ratio e % | | 22.5 | 21.0 | 19.5 | 18.0 | 8.0 |

TABLE 4

| | | (mm) | | |
|---|---|---|---|---|
| | | BD | $B_3$ | Total Reduction |
| Present Invention | With $Kb_O$ | 152.4 | 74.7 | $\Delta K = 77.7$ |
| | Thickness $Kt_O$ | 70.0 | 41.4 | $\Delta W_K = 28.6$ |
| Conventional Method | Width $Kb_O$ | 82.0 | 74.7 | $\Delta K = 7.3$ |
| | Thickness $Kt_O$ | 98.0 | 41.4 | $\Delta W_K = 56.6$ |

Figure 4:
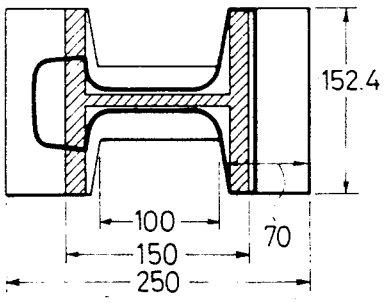
FIG. 4 shows the cross sections of the beam blank, H-section and rail according to this invention, one being superimposed on the other.

As can be seen from Table 4, the conventional method forms the rail head mainly by thichnesswise reduction, whereas the method according to this invention does this mainly by widthwise reduction. The method of this invention applies a considerable amount of reduction in the direction of thickness as well, in order to prevent the development of surface defects. FIG. 4 shows a beam blank for the RE1321b rail and a 150 mm by 150 mm H-section superimposed. It is obvious that the 150 mm by 150 mm H-section also can be manufactured from the beam blank for the RE1321b rail.

Rails can be manufactured using a rolling mill for intermediate-size H-sections not larger than 400 mm by 200 mm (with a unit weight of not heavier than 66 kg per meter), the unit weight of the heaviest 1551b rail being approximately 77 kg per meter. The 400 mm by 200 mm and 300 mm by 150 mm H-sections are among those which are most heavily in demand. Recently there is a growing tendency for the intermediate-size H-section mills to be built according to the continuous rolling concept.

With such a background in mind, this invention proposes a method of continuous rail rolling that is suited for an H-section mill comprising a mill train shown in FIG. 1*b* or one that is similar thereto which can be used also for the manufacture of rails. The key point in increasing the productivity of such a mill is to reduce the time of breakdown rolling.

The time for rolling a 100 m long rail on the finishing stand is approximately 20 seconds. The conventional breakdown stand $BD_1$ shown in FIG. 1*a* is not suited for the mill in FIG. 1*b* because the rolling time thereon is 70 seconds. By contrast, the breakdown stand according to this invention is appropriate since it requires only 30 seconds for rolling thereon. The shorter rolling time results in a reduction in the drop of the steel temperature. In addition, an ensuing reduction in power consumption during the idling time of the continuous rolling mill (due to the difference in the breakdown time) brings about a very great overall energy saving.

As described in the foregoing, this invention provides an epoch-making technique which comprises using a simple H-shaped beam blank for universal rail rolling, thereby remarkably enhancing the efficiency of the roughing process, and using the same breakdown rolls that are used also for the manufacture of H-sections, I-beams and other similar shapes on the same mill.

This invention is not limited to the preferred embodiments described above. FIG. 1*b* shows the optimum arrangement of passes for the manufacture of rails having standard dimensions and shape. The number and order of passes may be changed according to the size and shape of the rail.

What is claimed is:

1. A method of rolling mills from hot-rolled blooms, comprising:

breakdown rolling a bloom having a square or rectangular cross-section for breaking down the bloom to a substantially H-shaped beam blank having a cross-section symmetrical with respect to the center line of the web thereof; and passing the thus rolled bloom successively through a plurality of universal rolling stands, a plurality of head-wheel rolling stands and a plurality of base-wheel rolling stands in only a single pass through each stand and rolling with the horizontal rolls in said base-wheel rolling stands the flange of said beam blank which corresponds to the head of the rail for widthwise reduction thereof and rolling with a vertical roll thereof the flange of the beam blank which corresponds to the base of the rail for thickness reduction thereof, and rolling with a vertical roll in said head-wheel rolling stands the flange of the beam blank which corresponds to the head of the rail for thickness reduction thereof.

2. A method as claimed in claim 1 in which the step of breakdown rolling comprises breakdown rolling the bloom to a substantially H-shaped beam blank having a web slightly thicker than the web of the finished rail, one flange as wide as the flange of the finished rail and substantially thicker than the thickness of the flange of the finished rail, and the other flange substantially as thick as the thickness of the finished rail head and susbstantially wider than the finished rail head.

3. A method as claimed in claim 1 in which the step of passing the thus rolled bloom through the plurality of stands comprises passing it through a base-wheel rolling stand, through first and second universal rolling stands, a second base-wheel rolling stand, a first head-wheel rolling stand, a third universal rolling stand, a second head-wheel rolling stand and then a third base-wheel rolling stand.

4. A method of rolling rails from hot-rolled blooms, comprising:

providing a succession of universal rolling stands suitable for rolling an H-shaped beam from an H-shaped beam blank by passing the blank through the universal rolling stands in a single pass through each stand;

converting some of said universal rolling stands in said succession into a plurality of head-wheel rolling stands and a plurality of base-wheel rolling stands;

breakdown rolling a bloom having a square or rectangular cross-section for breaking down the bloom to a substantially H-shaped beam blank having a cross-section symmetrical with respect to the center line of the web thereof; and passing the thus rolled bloom successively through the plurality of universal rolling stands, plurality of head-wheel rolling stands and plurality of base-wheel rolling stands in the succession of stands with the converted stands therein in only a single pass through each stand and rolling with the horizontal rolls in said base-wheel rolling stands the flange of said beam blank which corresponds to the head of the rail for widthwise reduction thereof and rolling with a vertical roll thereof the flange of the beam blank which corresponds to the base of the rail for thickness reduction thereof, and rolling with a vertical roll in said head-wheel rolling stands the flange of the beam blank which corresponds to the head of the rail for thickness reduction thereof.

* * * * *